US008349097B2

(12) United States Patent
Lo et al.

(10) Patent No.: US 8,349,097 B2
(45) Date of Patent: Jan. 8, 2013

(54) DEZINCIFICATION-RESISTANT COPPER ALLOY AND METHOD FOR PRODUCING PRODUCT COMPRISING THE SAME

(75) Inventors: Wen Lin Lo, Taichung (TW); Xiao Rong Fang, Shenzhen (CN)

(73) Assignee: Modern Islands Co., Ltd., Tortola (VG)

( * ) Notice: Subject to any disclaimer, the term of this patent is extended or adjusted under 35 U.S.C. 154(b) by 175 days.

(21) Appl. No.: 12/561,980

(22) Filed: Sep. 17, 2009

(65) Prior Publication Data

US 2011/0061774 A1 Mar. 17, 2011

(51) Int. Cl.
*C22C 9/02* (2006.01)

(52) U.S. Cl. ..... 148/433; 148/434; 420/476; 420/477

(58) Field of Classification Search ..... 148/433, 148/434; 420/476, 477
See application file for complete search history.

(56) References Cited

U.S. PATENT DOCUMENTS

| | | | | |
|---|---|---|---|---|
| 2,118,688 | A * | 5/1938 | Webster | 420/477 |
| 4,417,929 | A | 11/1983 | Tomaru et al. | |
| 5,487,867 | A * | 1/1996 | Singh | 420/471 |
| 5,507,885 | A | 4/1996 | Sakai et al. | |
| 5,637,160 | A | 6/1997 | Brock et al. | |
| 5,653,827 | A | 8/1997 | Kramer et al. | |
| 6,395,110 | B2 | 5/2002 | Mizoguchi et al. | |
| 6,599,378 | B1 | 7/2003 | Hagiwara et al. | |
| 6,787,101 | B1 | 9/2004 | Dcker et al. | |
| 6,974,509 | B2 | 12/2005 | Hagiwara et al. | |

FOREIGN PATENT DOCUMENTS

| | | | |
|---|---|---|---|
| CN | 1906317 | A | 1/2007 |
| JP | 2005281714 | A * | 10/2005 |

OTHER PUBLICATIONS

Jihui Wang et al., "Advances of Researches on the Dezincification Mechanism of Brass", Chinese Journal of Materials Research, vol. 13, pp. 1-8 (1999).

* cited by examiner

*Primary Examiner* — Sikyin Ip
(74) *Attorney, Agent, or Firm* — Edwards Wildman Palmer LLP; Peter F. Corless

(57) ABSTRACT

A dezincification-resistant copper alloy and a method for producing a product containing the same are proposed by the present invention. The dezincification-resistant alloy of the present invention contains 59.5 to 64 wt % of copper (Cu); 0.1 to 0.5 wt % of bismuth (Bi); 0.08 to 0.16 wt % of arsenic (As); 5 to 15 ppm of boron (B); 0.3 to 1.5 wt % of tin (Sn); 0.1 to 0.7 wt % of zirconium (Zr); less than 0.05 wt % of lead (Pb); and zinc (Zn) in balance. The dezincification-resistant copper alloy of the present invention has excellent casting properties, good toughness and machinability, and can be corrosion-resistant. Thus, the alloy can reduce dezincification on the surfaces.

6 Claims, 7 Drawing Sheets

DEZINCIFICATION-RESISTANT COPPER ALLOY AND METHOD FOR PRODUCING PRODUCT COMPRISING THE SAME

BACKGROUND OF THE INVENTION

1. Field of the Invention

The present invention relates to dezincification-resistant copper alloys methods for producing a product comprising the same, and more particularly, to a dezincification-resistant low lead brass alloy and a method for producing a product comprising the same.

2. Description of Related Art

Brass comprises copper and zinc, as major ingredients, usually at a ratio of about 7:3 or 6:4. If the zinc content of brass exceeds 20 wt %, corrosion (such as dezincification) is likely to occur. For example, when a brass alloy article is employed in the environment, zinc present on the alloy surface is preferentially dissolved and copper contained in the alloy remains on the base metal, thereby causing corrosion in the form of porous, brittle copper. Generally, if the zinc content is less than 15 wt %, dezincification is not likely to occur. However, as the zinc content increases, the sensitivity to dezincification is increased. If the zinc content exceeds 30 wt %, dezincification corrosion is more apparent.

It has been reported in literature that alloy compositions and environmental factors affect dezincification corrosion. In the context of alloy compositions, dezincification of brass with a single a phase and zinc content higher than 20 wt % gives porous copper, whereas dezincification of brass with double $\alpha+\beta$ phases begins initially in $\beta$ phase and later expands to $\alpha$ phase when $\beta$ phase is completely converted into loosely-structured copper (refer to Kuaiji Wang et al., Chinese Journal of Materials Research, Vol. 13, pages 1-8).

Because dezincification of brass severely damages the structures of brass alloys, the surface intensities of brass products produced from brass alloys are lowered such that porosity occurs on brass pipes. This significantly lowers the lifetimes of the brass products, thereby causing application problems. In particular, under the conditions of a marine climate, the lifespan of hot water products are directly affected. Therefore, AS 2345, ISO 6509, etc. are used internationally by various countries to specify the dezincification resistance of brass products. Using the standard set forth in AS 2345 established in Australia as an example, the depth of a dezincification layer formed on the surface of a brass product shall not exceed 100 μm. However, there is also literature reporting that common brass products are not likely to meet the high standards set forth in AS 2345 (referring to Casting Technology, 2007, volume 9, pages 1272-1274). Hence, the industry continues to develop dezincification-resistant copper alloys.

Regarding the formulations of dezincification resistant brass alloys, in addition to copper and zinc as major constituents, U.S. Pat. No. 4,417,929 discloses a formulation comprising iron, aluminum and silicon, U.S. Pat. No. 5,507,885 and U.S. Pat. No. 6,395,110 disclose formulations comprising phosphorus, tin and nickel, U.S. Pat. No. 5,653,827 discloses a formulation comprising iron, nickel and bismuth, U.S. Pat. No. 6,974,509 discloses a formulation comprising tin, bismuth, iron, nickel and phosphorus, U.S. Pat. No. 6,787,101 discloses a formulation comprising phosphorus, tin, nickel, iron, aluminum, silicon and arsenic at the same time, and U.S. Pat. No. 6,599,378 and U.S. Pat. No. 5,637,160 discloses adding selenium and phosphorus in a brass alloy to achieve a dezincifying effect. Moreover, CN 1906317 discloses a formulation comprising bismuth, tin, nickel and phosphorus. The alloy has an excellent dezincification-resistant corrosion property even without performing heat treatment, wherein the specific conditions of the heat treatment are not disclosed. Additionally, there is also literature disclosing adding boron, arsenic, etc. in a brass alloy to achieve a dezincifying effect (refer to Kuaiji Wang et al., Chinese Journal of Materials Research, volume 13, pages 1-8).

Conventional dezincification-resistant brasses usually have higher lead contents (most in the range from 1 to 3 wt %), facilitating cold/thermal processing of brass materials. However, as the awareness of environmental protection increases and the impacts of heavy metals on human health and issues like environmental pollution become major focuses, there is a tendency to restrict the usage of lead-containing alloys. Various countries such as Japan, the United States, etc, have progressively amended relevant regulations, applying pressure to lower lead content in the environment by particularly demanding that no lead shall leach from the lead-containing alloy materials used in products encompassing household electronic appliances, automobiles and water systems to the surroundings or drinking water, and lead contamination shall be avoided during processing. Thus, the industry continues to develop brass materials, and to find an alloy formulation that can substitute for lead-containing brasses while possessing desirable properties like good casting and mechanical properties as well as corrosion resistance.

SUMMARY OF THE INVENTION

In order to attain the above and other objectives, the present invention provides a dezincification-resistant copper alloy, comprising 59.5 to 64 wt % of copper (Cu), 0.1 to 0.5 wt % of bismuth (Bi), 0.08 to 0.16 wt % of arsenic (As), 5 to 15 ppm of boron (B), 0.3 to 1.5 wt % of tin (Sn), 0.1 to 0.7 wt % of zirconium (Zn), less than 0.05 wt % of lead (Pb) and zinc (Zn) in balance.

In the dezincification-resistant low-lead brass alloy of the present invention, the copper content ranges from 59.5 to 64 wt %. In a preferred embodiment, the copper content ranges from 62 to 64 wt %. The range of the copper content can provide good toughness, so that subsequent processing of the alloy material is facilitated.

In the dezincification-resistant copper alloy of the present invention, the bismuth content ranges from 0.1 to 0.5 wt %. In a preferred embodiment, the bismuth content ranges from 0.3 to 0.5 wt %. Addition of bismuth is advantageous to retaining the machinability of brass.

In the dezincification-resistant copper alloy of the present invention, the arsenic content ranges from 0.08 to 0.16 wt %. In a preferred embodiment, the arsenic content ranges from 0.10 to 0.14 wt %. Addition of an adequate amount of arsenic can significantly increase the dezincification corrosion resistance of brass.

In the dezincification-resistant copper alloy of the present invention, the boron content ranges from 5 to 15 ppm. In a preferred embodiment, the boron content ranges from 7 to 13 ppm. Addition of an adequate amount of boron can refine the grains of the alloy material, thereby improving the properties of the alloy material.

In the dezincification-resistant copper alloy of the present invention, the tin content ranges from 0.3 to 1.5 wt %. In a preferred embodiment, the tin content ranges from 0.3 to 0.8 wt %. Addition of an adequate amount of tin can increase the intensity and the corrosion resistance of the alloy material.

In the dezincification-resistant copper alloy of the present invention, the zirconium content ranges from 0.1 to 0.7 wt %. In a preferred embodiment, the zirconium content ranges from 0.3 to 0.5 wt %. Addition of an adequate amount of zirconium can refine the grains of the alloy material, thereby enhancing the mechanical properties of the alloy material.

The dezincification-resistant copper alloy of the present invention comprises an extremely low lead content (i.e., less than 0.05 wt %) or even no lead. As compared with conventional brass alloys, the lead content is substantially lowered, thereby facilitating environmental protection. The alloy can possibly have impurities therein. The content of the unavoidable impurities is less than 0.1 wt %.

The dezincification-resistant copper alloy of the present invention has excellent casting properties, toughness, machinability, and corrosion resistance (which lowers dezincification of surfaces).

The present invention further provides a method for producing a product comprising a copper alloy, comprising the steps of:

(a) melting a brass ingot comprising a dezincification-resistant copper alloy of the present invention and scrap returns to boiling to form a molten copper liquid;

(b) casting the molten copper liquid into a mold;

(c) cooling the mold to allow the molten copper liquid to form a casting product, and releasing the casting product from the mold;

(d) heat treating the casting product to a temperature ranging from 560° C. to 620° C., and holding at that temperature for a period of time (e.g., 4 to 6 hours); and (e) naturally cooling the casting product.

In the method, the brass ingot in step (a) comprises 70 to 90 wt % of the dezincification-resistant copper alloy of the present invention and 10 to 30 wt % of the scrap returns. In a preferred embodiment, the brass ingot comprises 75 to 85 wt % of the dezincification-resistant copper alloy of the present invention and 15 to 25 wt % of the scrap returns. In an embodiment, 80 wt % of a dezincification-resistant brass alloy and 20 wt % of the scrap returns are placed in an induction furnace for smelting and then forming into a brass ingot. "Scrap returns" is a technical term that is conventionally used in the art. In the specification of the present invention, the residual metal scraps obtained after performing processes like casting processing on the dezincification-resistant copper alloy of the present invention can be recycled for re-use in casting processes.

In the embodiment, the brass ingot and the scrap returns are preheated to a temperature ranging from 400° C. to 500° C., and then melting the brass ingot and the scrap returns mixed at a weight ratio ranging from 3:1 to 5:1 to boiling to form a molten copper liquid. In a preferred embodiment, the brass ingot and the scrap returns are mixed at a weight ratio of 4:1. A sand cleaning treatment is performed on the scrap returns before they are preheated, so as to remove sand and iron wires from the scrap returns.

Then, a mold is provided. The mold can be preheated to 200° C., followed by casting the molten copper liquid into the mold. The casting step can be achieved by gravity casting. The casting temperature is controlled to between 1010 to 1060° C.

The casting product is released from the mold at 10 to 15 seconds after completing the casting or when the casting product is not red hot. After the casting product is released, a heat treatment process can be performed on the casting product by using a resistance furnace at a heating rate of 1 to 5° C./min, and preferably at a heating rate of 2 to 3° C./min. The casting product is heated to a temperature ranging from 560° C. to 620° C., and held at the temperature for up to 4 hours. Then, the heat treatment is terminated, and the casting product is allowed to cool down naturally.

In the method of the present invention, a heat treatment is performed on the casting product for a period of time at a temperature ranging from 560° C. to 620° C., so as to reduce the residual stress and defects in alloy grains. If the heat treatment is performed at a temperature lower than 400° C., the residual stress cannot be completely eliminated and the number of point defects cannot be reduced. However, if the heat treatment is performed at a temperature higher than 560° C., the defects (such as dislocation) in the alloy grains can be reduced in addition to eliminating the point defects and residual stress. Accordingly, the dezincification resistance of the copper alloy can be increased, thereby decreasing the depth of dezincification corrosion. On the other hand, if the heat treatment is performed at a temperature higher than 620° C., bismuth comprised in the copper alloy is likely to segregate on the grain boundary to form a thin film. This increases the brittleness of the material, and lowers the inhibitory effect on the diffusion of zinc through the grain boundary, thereby decreasing the dezincification resistance of the copper alloy. It should be noted that dezincification resistance of a copper alloy decreases over increasing temperatures.

By employing the method of the present invention, heat treatment, a holding temperature and cooling are used to process the casting product, so as to lower the toughness of the alloy material of the present invention and increase the plasticity and machinability thereof. Further, the residual stress of the alloy material is reduced, thereby lowering the stress corrosion. The dezincification resistance of the alloy material is also increased.

DETAILED DESCRIPTION OF THE PREFERRED EMBODIMENTS

Figure 1B:
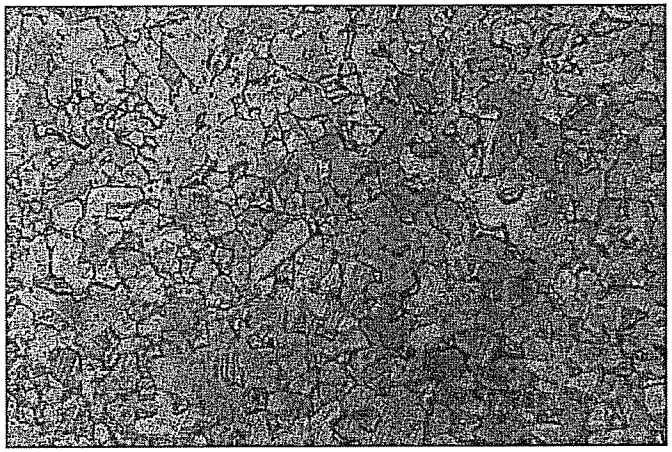
FIG. 1B is a metallographic structural distribution of a specimen of a dezincification-resistant copper alloy of the present invention in example 1 after heat treatment was performed at 620° C.

The detailed description of the present invention is illustrated by the following specific examples. Persons skilled in the art can conceive other advantages and effects of the present invention based on the disclosure contained in the specification of the present invention.

Unless otherwise specified, the constituent ingredients in the dezincification-resistant copper alloy of the present invention, as discussed herein, are all based on the total weight of the alloy, and are expressed in weight percentages (wt %).

In an embodiment, the dezincification-resistant copper alloy of the present invention comprises 59.5 to 64 wt % of copper, 0.1 to 0.5 wt % of bismuth, 0.08 to 0.16 wt % of arsenic, 5 to 15 ppm of boron, 0.3 to 1.5 wt % of tin, 0.1 to 0.7 wt % of zirconium and zinc in balance. The copper alloy may or may not comprise lead. If the copper alloy comprises lead, the lead content is less than 0.5 wt %.

In an embodiment, the dezincification-resistant copper alloy comprises 59.5 to 64 wt % of copper, 0.1 to 0.5 wt % of bismuth, 0.08 to 0.16 wt % of arsenic, 5 to 15 ppm of boron, 0.3 to 1.5 wt % of tin, 0.1 to 0.7 wt % of zirconium, less than 0.05 wt % of lead, less than 0.1 wt % of unavoidable impurities and zinc in balance.

In an embodiment, the dezincification-resistant copper alloy of the present invention comprises 62 to 64 wt % of copper, 0.3 to 0.5 wt % of bismuth, 0.10 to 0.14 wt % of arsenic, 7 to 13 ppm of boron, 0.3 to 0.8 wt % of tin, 0.3 to 0.5 wt % of zirconium, less than 0.1 wt % of unavoidable impurities and zinc in balance.

The dezincification-resistant low-lead copper alloy according to the present invention can achieve the material properties (such as machinability) possessed by conventional lead brasses or dezincification-resistant brasses. Further, this type of dezincification-resistant low-lead copper alloy material is not prone to generate product defects like cracks and slag inclusions, and complies with the dezincification requirement set forth in AS-2345. Also, the copper alloy formulation of the present invention is effective in lowering the production cost of a dezincification-resistant low-lead copper alloy, and is extremely advantageous to commercial-scale productions and applications.

Moreover, the dezincification-resistant copper alloy formulation of the present invention can lower the lead content to less than 0.05 wt %. Therefore, the alloy formulation facilitates manufacturing of water faucets and laboratory components, water pipelines for supplying tap water, water supply systems, and so on.

The present invention is illustrated by the following exemplary examples.

The ingredients of the dezincification-resistant copper alloy of the present invention used in the following test examples are described below, wherein each of the ingredients is added in a proportion based on the total weight of the alloy.

EXAMPLE 1

| | |
|---|---|
| Cu: 63.3 wt % | Bi: 0.375 wt % |
| As: 0.122 wt % | B: 10 ppm |
| Sn: 0.837 wt % | Zr: 0.362 wt % |
| Pb: 0.013 wt % | Zn: in balance |

EXAMPLE 2

| | |
|---|---|
| Cu: 63.06 wt % | Bi: 0.335 wt % |
| As: 0.107 wt % | B: 8 ppm |
| Sn: 0.632 wt % | Zr: 0.433 wt % |
| Pb: 0.007 wt % | Zn: in balance |

EXAMPLE 3

| | |
|---|---|
| Cu: 62.6 wt % | Bi: 0.413 wt % |
| As: 0.138 wt % | B: 12 ppm |
| Sn: 0.431 wt % | Zr: 0.487 wt % |
| Pb: 0.009 wt % | Zn: in balance |

TEST EXAMPLE 1

The dezincification-resistant low lead brass alloy of the present invention and scrap returns were preheated for 15 minutes to reach a temperature higher than 400° C., and the two were mixed at a weight ratio of 7:1, along with addition of 0.2 wt % of refining slag, for melting in an induction furnace until the brass alloy reached a certain molten state (hereinafter referred to as "molten copper liquid"). A metallic gravity casting machine coupled with sand core and gravity casting molds to perform casting together with a temperature monitoring system further controlled the temperature so as to maintain the casting temperature to between 1010 and 1060° C. Casting was performed in batches. In each batch, the feed amount was preferably between 1 and 2 kg, and the casting time was controlled to a between 3 and 8 seconds.

After the molds were cooled, the molds were opened and the casting heads were cleaned. The mold temperatures were monitored so as to control the mold temperatures to between 200 and 220° C. to form casting parts. Then, the casting parts were released from the molds. Then, the molds were cleaned to ensure that the sites of the core head were clean. A graphite liquid was spread on the surface of the molds following by cooling by immersion. The temperature of the graphite liquid for cooling the mold was preferably maintained at between 30 and 36° C., and the specific weight of the graphite liquid ranged from 1.05 to 1.06.

Self-checking was performed on the cooled casting parts, and the casting parts were sent in a sand cleaning drum for performing a sand cleaning treatment. Then, a heat treatment was performed on as-cast to distress annealing, thereby eliminating the internal stress generated by casting. The heat treatment was performed using a resistance furnace at a heating rate of 2° C./min, to heat the as-casts to a temperature ranging from 560° C. to 620° C., and then they were held at that temperature for 4 hours. Then, the heat treatment was terminated, and the as-casts naturally cooled down. The as-casts were subsequently mechanically processed and polished, so that no sand, metal powder or other impurities adhered to the cavities of the casting parts. A quality inspection analysis was performed, and the overall production yield was calculated by the following equation.

$$\text{O.P. Yield} = \text{Number of Non-Defective Products}/\text{Total Number of Products} \times 100\%$$

The overall production yield reflects the qualitative stability of production processes. High qualitative stability of production processes ensures normal production.

Moreover, a conventional CW602N dezincification-resistant brass (which is sometimes abbreviated as DR brass, and certified as a dezincification-resistant brass according to AS2345-2006) and a commercially available lead-free bismuth brass were used in comparative examples in which products were produced by the same process as described above. The ingredients, processing characteristics and the overall production yield of each of the alloys are shown in FIG. 1.

TABLE 1

Ingredients, processing characteristics and total non-defectiveness in production of the alloys

| | | DR brass (CW602N) | | | Lead-free bismuth brass | | | Dezincification-resistant brass alloy | | |
|---|---|---|---|---|---|---|---|---|---|---|
| | | Comparative example 1 | Comparative example 2 | Comparative example 3 | Comparative example 4 | Comparative example 5 | Comparative example 6 | Example 1 | Example 2 | Example 3 |
| Measured Cu content (%) | | 61.39 | 62.92 | 62.14 | 63.28 | 62.91 | 61.87 | 63.3 | 63.06 | 62.6 |
| Measured Bi content (%) | | — | — | — | 0.435 | 0.142 | 0.289 | 0.375 | 0335 | 0.413 |
| Measured As content (%) | | 0.112 | 0.145 | 0.127 | — | — | — | 0.122 | 0.107 | 0.138 |
| Measured Pb content (%) | | 1.83 | 2.67 | 2.12 | 0.002 | 0.011 | 0.008 | 0.013 | 0.007 | 0.009 |
| Measured B content (ppm) | | — | — | — | — | — | — | 10 | 8 | 12 |
| Measured Zr content (%) | | — | — | — | — | — | — | 0.362 | 0.433 | 0.487 |
| Measured Sn content (%) | | 0.553 | 0.648 | 0.479 | 0.632 | 0.475 | 0.429 | 0.837 | 0.632 | 0.431 |
| Casting machine plus polishing | Input (pcs) | 150 | 150 | 150 | 150 | 150 | 150 | 150 | 150 | 150 |
| | Output (pcs) | 140 | 141 | 140 | 93 | 96 | 91 | 136 | 138 | 136 |
| Overall production yield | | 92% | 93% | 92% | 62% | 64% | 61% | 91% | 92% | 91% |

A hyphen represents absence of the ingredient or comprises the ingredient at a content lower than a measured value; wherein the lower limit of the measured value of each of the ingredients are as follows: Bi: 0.006%, As: 0.0005%, B: 1 ppm and Zr: 0.0005%.

It can be seen from Table 1 that the test group in which dezincification-resistant copper alloy according to the present invention was used as a raw material had an overall production yield higher than 90%. The yield of the alloy of the present invention was comparable to that of conventional DR brass (i.e., CW602N), and was significantly higher than that of the lead-free bismuth brass. Thus, the alloy of the present invention can indeed be a substitute brass material. Further, the dezincification-resistant copper alloy of the present invention can significantly decrease the lead content of the alloy, effectively avoid the lead contamination occurred during processes, and lower the amount of lead leached when using the casting parts. This allows the alloy of the present invention to possess the desired or needed physical characteristics while meeting the environmental requirements.

TEST EXAMPLE 2

Other than the temperature applied in the heat treatment being different (i.e., 560° C. or 620° C.), the alloy formulations in examples 1 and 2 were prepared into brass specimens according to the process described in test example 1. The specimens were placed under an optical metallographic microscope, and magnified at 100× to examine the structural distribution of the materials.

Figure 1A:
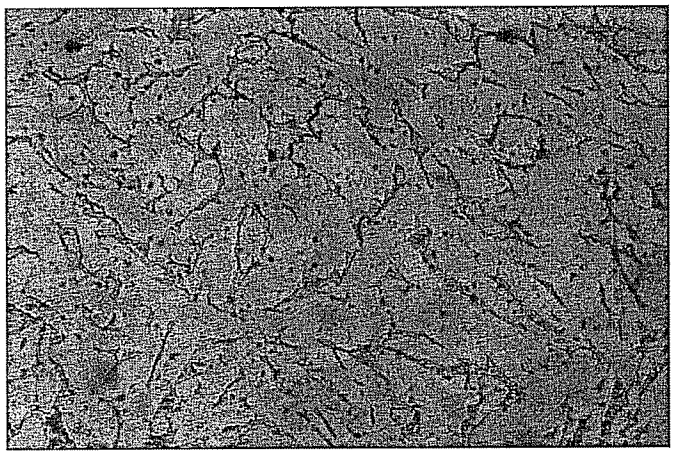
FIG. 1A is a metallographic structural distribution of a specimen of a dezincification-resistant copper alloy of the present invention in example 1 after heat treatment was performed at 560° C.
Figure 2B:
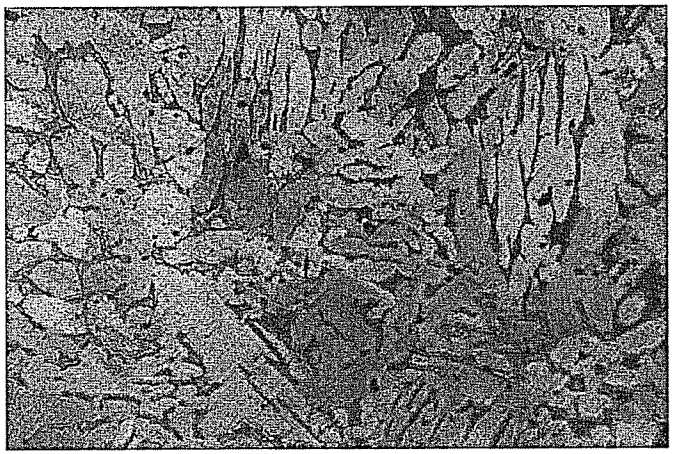
FIG. 2B is a metallographic structural distribution of a specimen of the dezincification-resistant copper alloy of the present invention in example 2 after heat treatment was performed at 620° C.
Figure 2A:
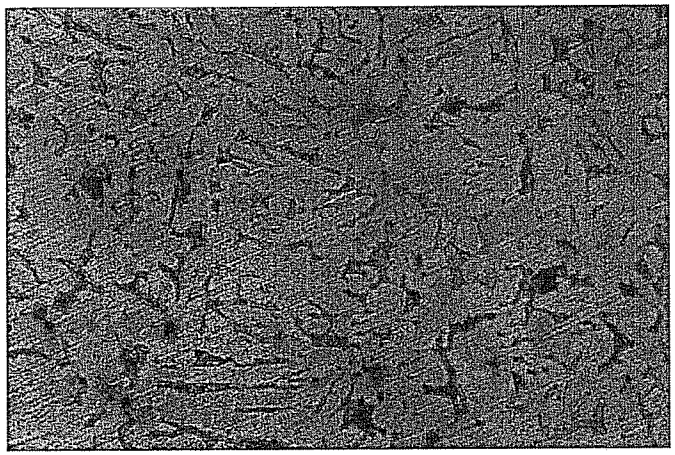
FIG. 2A is a metallographic structural distribution of a specimen of the dezincification-resistant copper alloy of the present invention in example 2 after heat treatment was performed at 560° C.
Figure 3C:
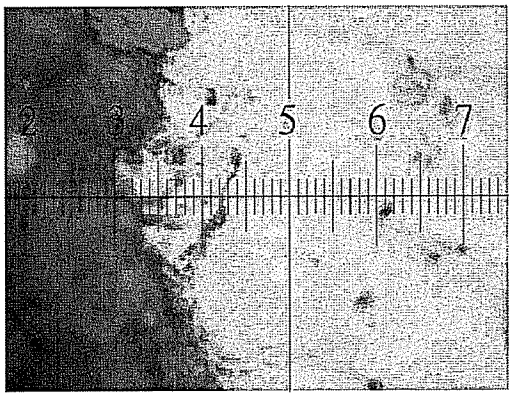
FIG. 3C is a metallographic structural distribution of a specimen of the dezincification-resistant copper alloy of the present invention in example 1 after a test of dezincification corrosion resistance following heat treatment performed at 400° C.
Figure 3B:
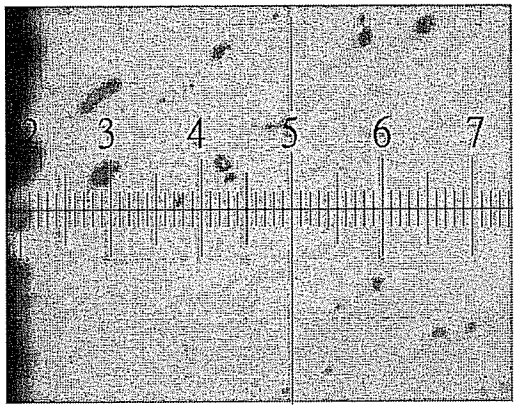
FIG. 3B is a metallographic structural distribution of a specimen of the dezincification-resistant copper alloy of the present invention in example 1 after a test of dezincification corrosion resistance following heat treatment performed at 620° C.
Figure 3A:
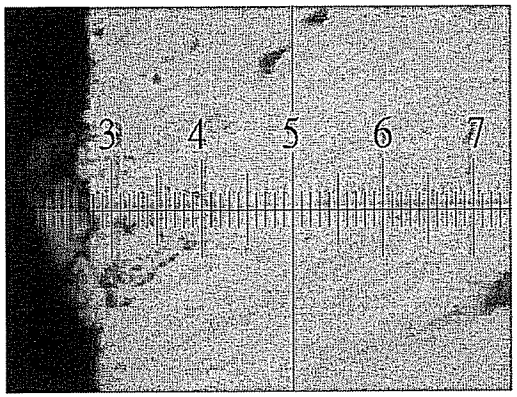
FIG. 3A is a metallographic structural distribution of a specimen of the dezincification-resistant copper alloy of the present invention in example 1 after a test of dezincification corrosion resistance following heat treatment performed at 560° C.
Figure 4A:
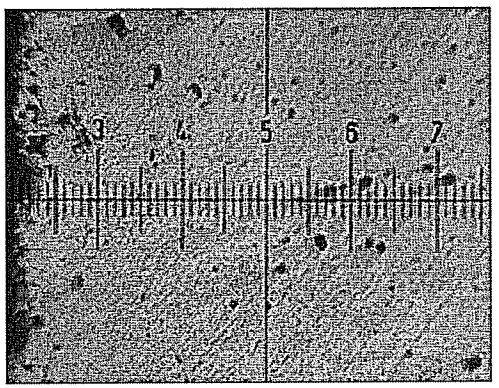
FIG. 4A is a metallographic structural distribution of a specimen of the dezincification-resistant copper alloy of the present invention in example 2 after a test of dezincification corrosion resistance following heat treatment performed at 560° C.
Figure 4B:
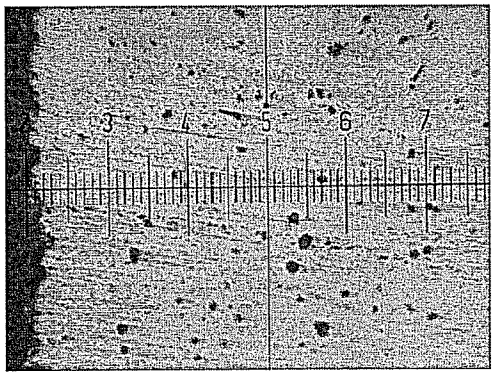
FIG. 4B is a metallographic structural distribution of a specimen of the dezincification-resistant copper alloy of the present invention in example 2 after a test of dezincification corrosion resistance following heat treatment performed at 620° C.
Figure 4C:
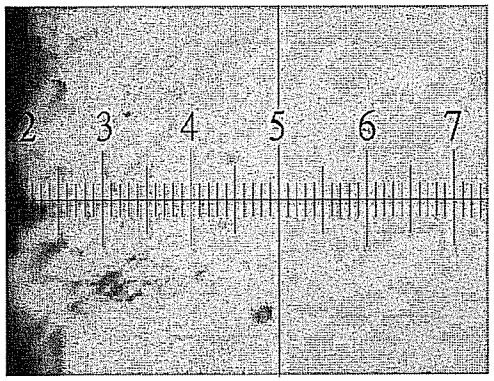
FIG. 4C is a metallographic structural distribution of a specimen of the dezincification-resistant copper alloy of the present invention in example 2 after a test of dezincification corrosion resistance following a heat treatment performed at 400° C.
Figure 5B:
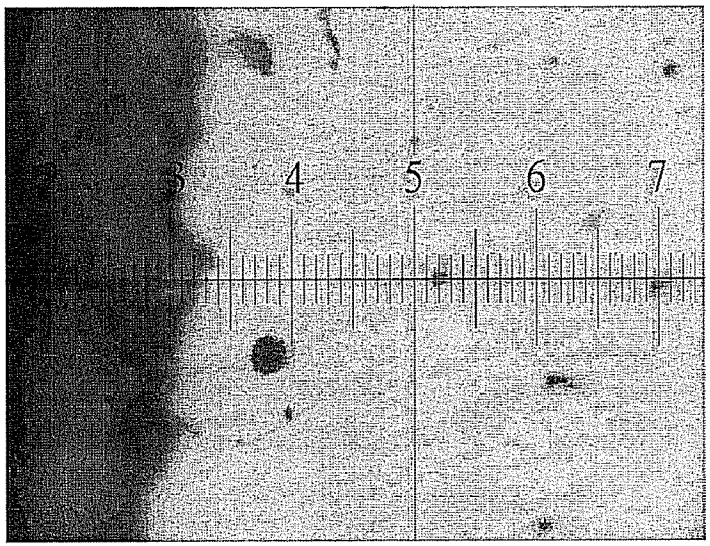
FIG. 5B is a metallographic structural distribution of a specimen of the CW602N copper after a test of dezincification corrosion resistance following heat treatment performed at 620° C.
Figure 5A:
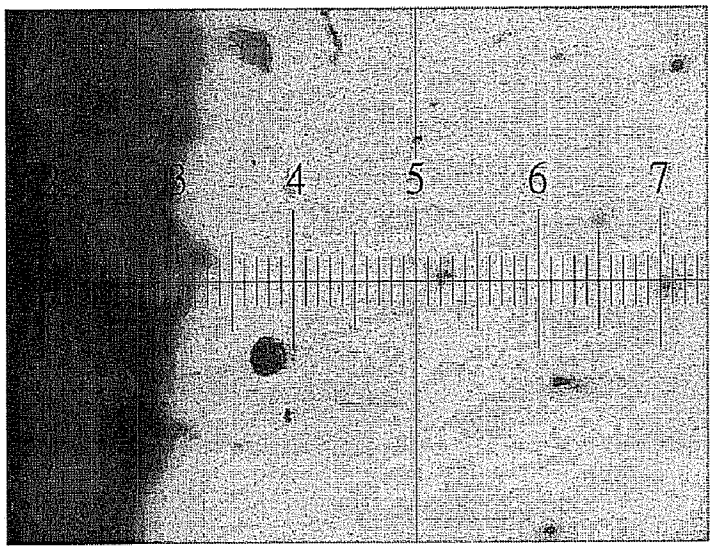
FIG. 5A is a metallographic structural distribution of a specimen of a CW602N copper after a test of dezincification corrosion resistance following heat treatment performed at 560° C.
Figure 5D:
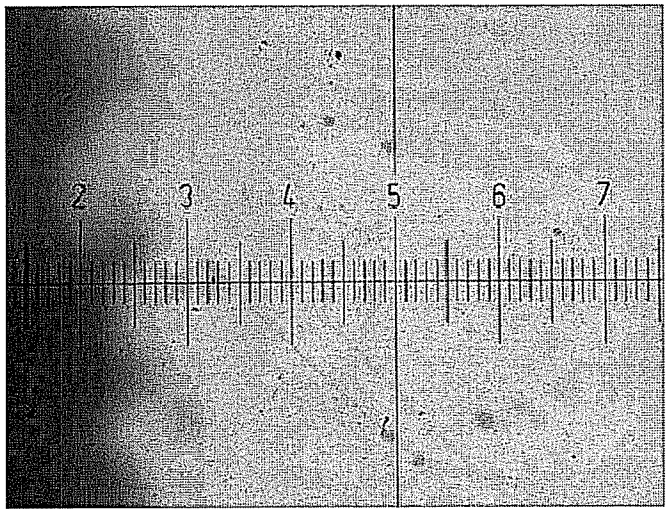
FIG. 5D is a metallographic structural distribution of a specimen of the CW602N copper after a test of dezincification corrosion resistance following heat treatment performed at 700° C.
Figure 5C:
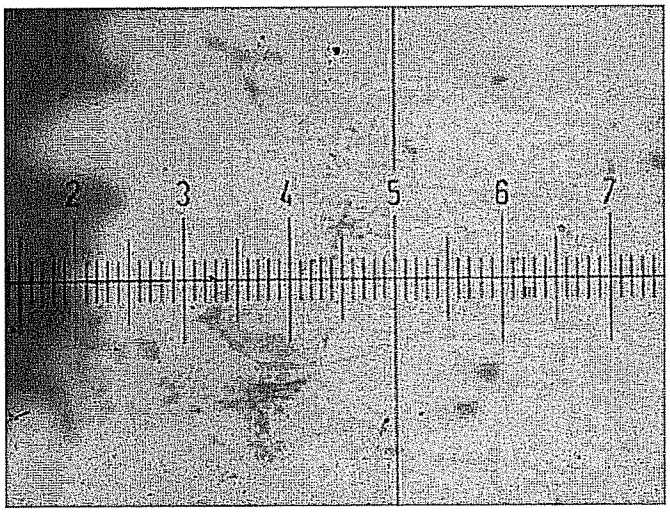
FIG. 5C is a metallographic structural distribution of a specimen of the CW602N copper after a test of dezincification corrosion resistance following heat treatment performed at 400° C.
Figure 7:
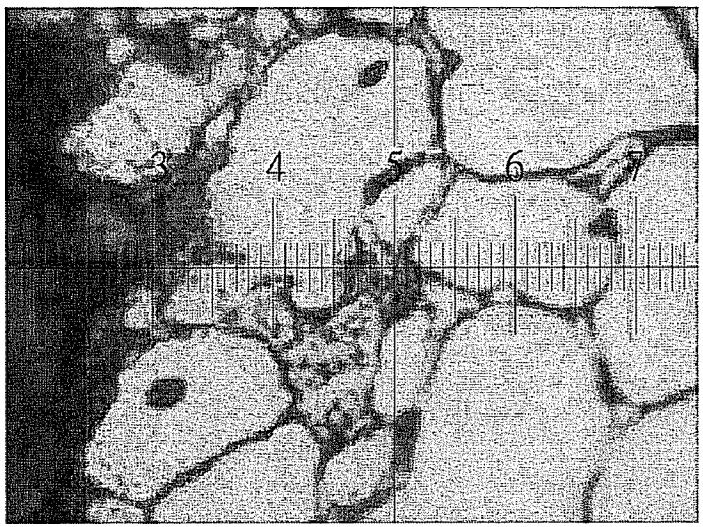
FIG. 7 is a metallographic structural distribution of a specimen of the CW602N copper after a test of dezincification corrosion resistance following heat treatment performed at 560° C.
Figure 6:
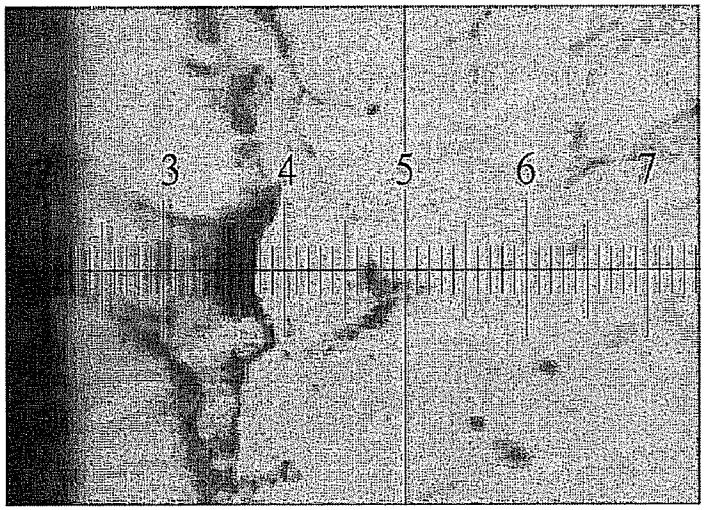
FIG. 6 is a metallographic structural distribution of a specimen of a lead-free bismuth copper after a test of dezincification corrosion resistance following heat treatment performed at 560° C.

The results of example 1 are shown in FIGS. 1A and 1B, wherein FIG. 1A shows the results of the specimens that were heat treated at 560° C., and FIG. 1B shows the results of the specimens that were heat treated at 620° C. The results of example 2 are shown in FIGS. 2A and 2B, wherein FIG. 2A shows the results of the specimens that were heat treated at 560° C., and FIG. 2B shows the results of the specimens that were heat treated at 620° C. As shown in FIGS. 1A through 2B, the structure of the dezincification-resistant copper alloy being heat treated is similar to a single a phase brass. The dezincification-resistant copper alloy has good dezincification resistance.

TEST EXAMPLE 3

Other then the temperature applied in the heat treatment being different, the alloy formulations in examples 1 and 2 and comparative examples 1, 4 and 5 were prepared into brass specimens according to the process described in test example 1, wherein the temperature conditions in the heat treatment are listed in Table 2.

A dezincification test was performed on the above brass specimens to test the corrosion resistance of the brasses. The dezincification test was performed according to the Australian standard AS2345-2006 "Dezincification resistance of copper alloys." Before the corrosion experiment was performed, a novolak resin was used to make the exposed area of each of the specimens to be 100 $mm^2$. The specimens were ground flat using a 600# metallographic abrasive paper, following by washing using distilled water. Then, the specimens were baked dry. The test solution was 1% $CuCl_2$ solution prepared before use, and the testing temperature was 75±2° C. The specimens and the $CuCl_2$ solution were placed in a temperature-controlled water bath to react for 24±0.5 hours. The specimens were removed from the water bath, and cut along the vertical direction. The cross-sections of the specimens were polished, and then the corrosion depths of the specimens were measured. Results are shown in FIGS. 2A and 2B. The dezincification of the brass alloy specimens were observed under a digital metallographic electron microscope, and results are shown in FIGS. 3A to 7.

TABLE 2

Summary of the heating conditions and the average depths of dezincification corrosion in examples 1 and 2 and comparative examples 1, 4 and 5

| Alloy formulation | Example 1 | | | Example 2 | | | Comparative example 1 | | Comparative example 4 | Comparative example 5 |
|---|---|---|---|---|---|---|---|---|---|---|
| Heating conditions | 560° C. | 620° C. | 400° C. | 560° C. | 620° C. | 700° C. | 560° C. | 620° C. | 560° C. | 560° C. |
| Average depth of dezincification corrosion (μm) | 12.6 | 9.6 | 180.6 | 12.4 | 14.3 | 132.1 | 91.3 | 82.1 | 324.1 | 781.1 |

As shown in Table 2 and FIGS. 3 to 7, when no heat treatment was performed, the depth of the dezincification layer of the dezincification-resistant copper alloy of the present invention was less than 200 μm, and the depth of the dezincification layer of the conventional CW602N brass exceeded 300 μm. When the heat treatment was performed at 700° C., the depth of the dezincification layer of the dezincification-resistant copper alloy of the present invention was less than 150 μm, and the depth of the dezincification layer of the conventional CW602N brass still exceeded 200 μm.

It was further found that when the heat treatment was performed at a temperature ranging from 520 to 620° C., the depths of dezincification layers of the dezincification-resistant copper alloy of the present invention and the conventional CW602N brass could both be less than 100 μm. Hence, the dezincification-resist copper alloy of the present invention and the conventional CW602N brass met the standard of dezincification resistance (i.e., "the depth of a dezincification layer formed on the surface of a brass product shall not exceed 100 μm") set forth in AS2345. This corroborated that by employing the method of the present invention to perform casting of products, the dezincification resistance of brass alloys were indeed improved. The dezincification resistance of the lead-free bismuth brass was the poorest among the tested samples. Specifically, even after the heat treatment was performed, the depth of the dezincification layer of the lead-free bismuth brass still exceeded 300 μm.

Moreover, by using the dezincification-resistant copper alloy formulation of the present invention, along with a heat treatment applied at a temperature ranging from 520 to 620° C., the depth of the dezincification layer can be less than 15 μm, thereby substantially increasing the dezincification resistance.

In conclusion, the dezincification-resistant brass alloy material of the present invention has excellent dezincification resistance, and can be coupled with suitable heat treatment conditions to further enhance the dezincification resistance of casting products produced therefrom. The dezincification-resistant brass alloy of the present invention has advantages like having good toughness and machinability, low production costs, high overall production yield and environmental friendliness while possessing properties essential for industrial production.

The invention has been described using exemplary preferred embodiments. However, it is to be understood that the scope of the invention is not limited to the disclosed arrangements. The scope of the claims, therefore, should be accorded the broadest interpretation, so as to encompass all such modifications and similar arrangements.

The invention claimed is:

1. A dezincification-resistant copper alloy, consisting of:

59.5 to 64 wt % of copper;

0.3 to 0.5 wt % of bismuth;

0.08 to 0.16 wt % of arsenic;

5 to 15 ppm of boron;

0.3 to 1.5 wt % of tin;

0.1 to 0.7 wt % of zirconium;

less than 0.05 wt % of lead; and zinc in balance.

2. The dezincification-resistant copper alloy of claim 1, wherein the copper is in an amount ranging from 62 to 64 wt %.

3. The dezincification-resistant copper alloy of claim 1, wherein the arsenic is in an amount ranging from 0.10 to 0.14 wt %.

4. The dezincification-resistant copper alloy of claim 1, wherein the boron is in an amount ranging from 7 to 13 ppm.

5. The dezincification-resistant copper alloy of claim 1, wherein the tin is in an amount ranging from 0.3 to 0.8 wt %.

6. The dezincification-resistant copper alloy of claim 5, wherein the zirconium is in an amount ranging from 0.3 to 0.5 wt %.

* * * * *